United States Patent [19]

Inoue et al.

[11] Patent Number: 4,458,651

[45] Date of Patent: Jul. 10, 1984

[54] ELECTRONICALLY CONTROLLED FUEL INJECTION SYSTEM FOR AN INTERNAL COMBUSTION ENGINE OF AN AUTOMOTIVE VEHICLE

[75] Inventors: Ryuzaburo Inoue, Yamato; Shoji Tange, Yokosuka; Yasuhiko Nakagawa, Kamakura, all of Japan

[73] Assignee: Nissan Motor Company, Ltd., Yokohama, Japan

[21] Appl. No.: 474,730

[22] Filed: Mar. 10, 1983

[30] Foreign Application Priority Data

Apr. 1, 1982 [JP] Japan ..... 57-52315

[51] Int. Cl.[3] ..... F02M 51/00

[52] U.S. Cl. ..... 123/492; 123/342

[58] Field of Search ..... 123/492, 493, 337, 342

[56] References Cited

U.S. PATENT DOCUMENTS

| | | | |
|---|---|---|---|
| 3,720,191 | 3/1973 | Rachel | 123/492 |
| 4,221,191 | 9/1980 | Asano et al. | 123/492 |
| 4,237,830 | 12/1980 | Stivender | 123/493 |
| 4,359,991 | 11/1982 | Stumpp et al. | 123/492 |
| 4,380,799 | 4/1983 | Allard et al. | 123/342 |
| 4,408,588 | 10/1983 | Mausner | 123/492 |

FOREIGN PATENT DOCUMENTS 1448279 9/1976 United Kingdom .

*Primary Examiner*—Parshotan S. Lall

*Attorney, Agent, or Firm*—Schwartz, Jeffery, Schwaab, Mack, Blumenthal & Koch

[57] ABSTRACT

An electronically controlled fuel injection system for an internal combustion engine which determines the pulse-width of a drive signal to be applied to a plurality of fuel injection valves, each located within an intake manifold, which in turn determines the fuel injection amount per engine revolution according to the engine operating conditions, the air-fuel mixture ratio being smoothly changed from a lean air-fuel mixture ratio to a richer air-fuel mixture ratio when the engine load changes from a partial load to a full load. Therefore, fuel consumption is remarkably reduced without worsening the handling of the vehicle in which the fuel injection system is incorporated.

3 Claims, 7 Drawing Figures

ELECTRONICALLY CONTROLLED FUEL INJECTION SYSTEM FOR AN INTERNAL COMBUSTION ENGINE OF AN AUTOMOTIVE VEHICLE

BACKGROUND OF THE INVENTION

1. Field of the Invention

The present invention relates to an electronically controlled fuel injection system for an internal combustion engine mounted in an automotive vehicle, particularly applicable to an engine of a construction wherein an extremely lean air-fuel mixture is burned.

2. Description of the Prior Art

A conventional electronically controlled fuel injection system applied to a four-cylinder engine comprises: (a) a plurality of fuel injection valves, each provided at an inlet port of an intake manifold of an engine body; (b) a throttle valve opening sensor attached to an axis of a throttle valve located within a throttle chamber interlinked with the intake manifold for detecting the fully-open position of the throttle valve; (c) an acceleration wire interlinking an accelerator pedal with the throttle valve so that the angle of inclination of the accelerator pedal corresponds to the angle of opening of the throttle valve; (d) an intake air quantity sensor located between the throttle valve and an air cleaner; and (e) a water temperature sensor for detecting the cooling water temperature of the engine. The conventional electronically controlled fuel injection system further comprises a control unit which measures a number of engine revolutions by counting the number of ignition pulses, each generated whenever a minus terminal of an ignition coil produces an ignition pulse, calculates the amount of fuel to be injected into the engine according to engine operating conditions from data on intake air quantity and engine cooling water temperature obtained by the intake air quantity sensor and the engine cooling water temperature sensor in order to derive the pulse width (valve opening time) of a drive pulse signal to be applied to each fuel injection valve. In addition, when the throttle valve is fully opened, the fuel injection amount is incremented by means of the control unit in response to an ON signal from the throttle valve opening sensor.

However, since in conventional electronically controlled fuel injection systems, the angle of inclination of the accelerator pedal corresponds to the throttle valve opening angle and the fuel injection amount is incremented at the full-load position of the throttle valve at which the angle of inclination of the accelerator is maximized, i.e., when the throttle valve is fully opened, in the case of a lean air-fuel mixture buring engine which runs on a lean air-fuel mixture ratio greater than 18 during partial-load driving, the air-fuel mixture would rapidly be changed to a rich mixture when the engine is switched from a partial-load condition to a full-load condition so that the vehicle traveling speed may change abruptly and vehicle handling be thereby worsened.

SUMMARY OF THE INVENTION

With the above-described problem in mind, it is an object of the present invention to provide an electronically controlled fuel injection system wherein the air-fuel mixture is gradually changed from a lean air-fuel mixture to a rich air-fuel mixture when the engine is switched from a partial-load state to a full-load state so that fuel consumption can be remarkably reduced without adversely affecting vehicle handling.

This can be achieved by selecting a fuel injection amount corresponding to the intake air quantity such that the air-fuel mixture ratio is maintained at a predetermined lean air-fuel mixture ratio value until the throttle valve is fully opened or opened to a predetermined opening angle, the predetermined opening angle being in the vicinity of fully-opened angle, with the throttle valve being fully opened before the accelerator pedal is to the maximum degree and correcting the fuel injection amount such that the angle of inclination of the accelerator corresponds to the fuel injection amount as the angle of inclination approaches its maximum within a range of angle of inclination wherein the throttle valve is fully opened or opened beyond the predetermined opening angle described hereinabove.

BRIEF DESCRIPTION OF THE DRAWINGS

A more complete understanding of the present invention may be obtained from the following detailed description taken in conjunction with the drawings in which like reference numerals designate corresponding elements and in which.

DETAILED DESCRIPTION OF THE PREFERRED EMBODIMENTS

Reference will be made to the drawings in order to facilitate understanding of the present invention.

Figure 1:
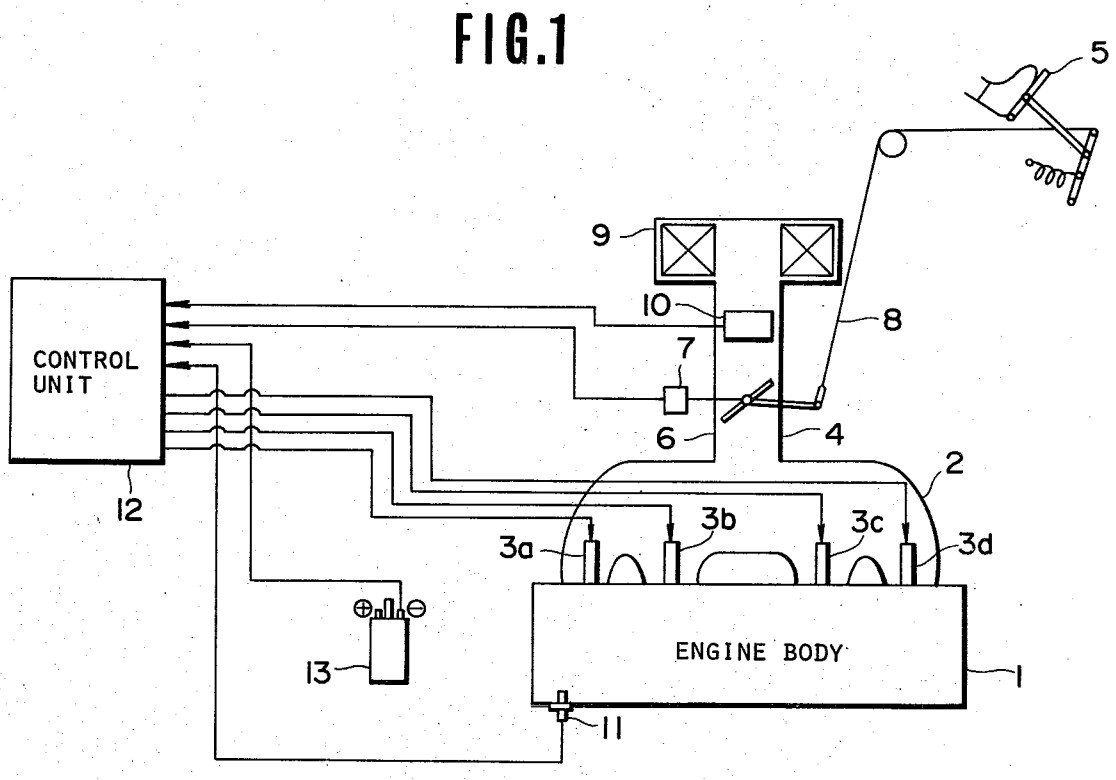
FIG. 1 is a schematic drawing of a conventional electronically controlled fuel injection system.

First, FIG. 1 shows a conventional electronically controlled fuel injection system applied to a four-cylinder internal combustion engine.

In FIG. 1, numeral 1 denotes an engine body, numeral 2 denotes an intake manifold, and numerals 3*a* through 3*d* denote fuel injection valves each located within the intake manifold 2. Numeral 4 denotes a throttle chamber housing a throttle valve 6 interlinked with an accelerator pedal 5. A throttle valve opening sensor 7 is attached to the axle of the throttle valve 6 to detect the fully opened state of the throttle valve 6. An accelerator cable 8 provides a means for connecting the accelerator pedal 5 to the throttle valve 6. It should be noted that the angle of inclination of the accelerator pedal 5 corresponds to the opening angle of the throttle valve 6. The angle of inclination of the accelerator pedal 5 means the angle through which a driver depresses the accelerator pedal 5 with the bottom of the accelerator pedal 5 serving as the pivot point. An intake air quantity sensor 10 is provided between an air cleaner 9 and throttle valve 6. In addition, a cooling water temperature sensor 11 is provided within the engine body 1 to detect engine cooling water temperature. A control unit 12 is provided which derives the number of engine revolutions from an ignition coil 13 by counting the number of ignition pulses generated at a minus terminal of the ignition coil 13, reads the output of the intake air quantity and cooling water temperature sensors 10 and 11, calculates a fuel injection amount according to engine operating conditions from these data to control the valve-opening duration of each fuel injection valve 3*a* through 3*d*, the valve-opening duration corresponding to the calculated fuel injection amount and to the duration of the ON level of a drive signal sent to each fuel injection valve 3*a* through 3*d*. Incrementation of the fuel injection amount is carried out by the control unit 12 in response to the ON state of a signal from the throttle opening sensor 7 when the throttle valve is fully opened. An accelerator angle sensor 18, e.g., comprises a potentiometer (not shown) which converts the physical angle of inclination of the accelerator pedal 6 into a corresponding voltage level. The output of the accelerator angle sensor 18 changes only over the range of inclination angles at which the throttle valve 6 is fully closed. Numeral 20 denotes a crank angle sensor which generates a 180° signal, a 720° signal, and a 1° signal in synchronization with the engine revolution. The 180° signal has a period of 180° of crankshaft rotation, the 720° signal has a period of 720° of crankshaft rotation, and the 1° signal has a pulsewidth of 1° of crankshaft rotation. The control unit 12 receives output signals from each of throttle valve opening sensor 7, intake air quantity sensor 10, cooling water temperature sensor 11, the accelerator angle sensor 18, crank angle sensor 20, calculates the fuel injection amount on the basis of these output signals, and controls accordingly the pulsewidth of the drive signal to be sent to the fuel injection valves 3*a* through 3*d*.

Figure 2:
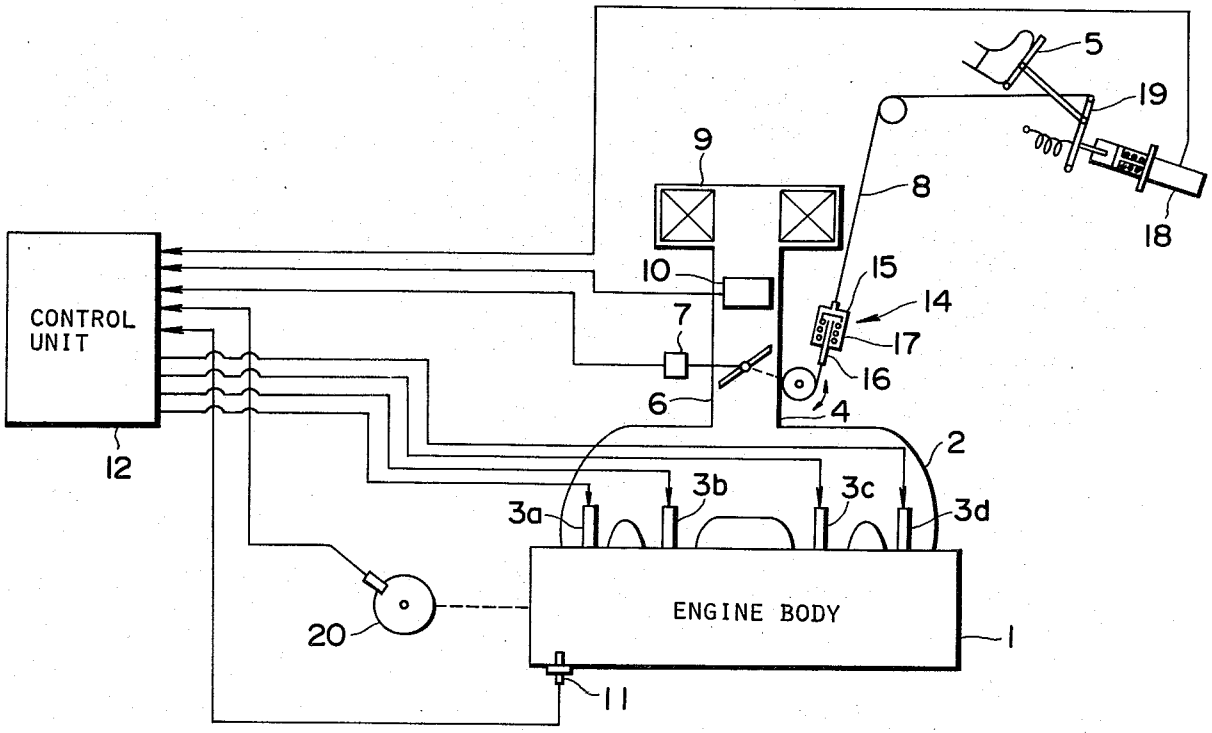
FIG. 2 is a schematic drawing of a preferred embodiment of an electronically controlled fuel injection system according to the present invention.

FIG. 2 shows a preferred embodiment of an electronically controlled fuel injection system.

In contrast to the conventional fuel injection system shown in FIG. 1, a displacement cancelling device 14 is installed at an intermediate point along the accelerator cable 8. The displacement cancelling device 14 absorbs the displacement of accelerator pedal 5 beyond a predetermined position by the way deformation of a spring 17 interposed between a cylinder housing 15 and rod 16. One end of the cylinder housing 15 is connected to the accelerator pedal 5 via the cable 8. One end of the rod 16 is connected to the throttle valve 6 via the cable 8. The accelerator pedal 5 is interlinked via the cable 8 and displacement cancelling device 14 with the throttle valve 6 such that the throttle valve 6 is fully opened before the angle of inclination of the accelerator pedal 5 reaches its maximum.

In FIG. 2, when the driver depresses the accelerator pedal 5, the accelerator cable 8 is pulled by the accelerator pedal 5, i.e., by an accelerator pedal link 19 according to the displacement of the accelerator pedal 5 whereupon the cylinder 15 of the displacement cancelling device 14 is pulled correspondingly. Since the rod 16 actuates the throttle valve 6 and the spring 17 is more resistant to deformation than the angular orientation of the throttle valve, displacement of cylinder 15 results directly in rotation of the throttle valve 6 until the throttle valve is fully open and thus resists further rotation.

In this case, the link ratio of the accelerator pedal link 19 is set such that the throttle valve is fully opened before the accelerator angle reaches its limit. When the throttle valve 6 is fully opened, the throttle valve opening sensor 7 outputs an ON signal. As the driver continues to depress the accelerator pedal 5, the spring 17 of the displacement cancelling device 14 is deformed to absorb the displacement of the accelerator pedal 5. In this way, the accelerator angle can change up to its maximum angle while the throttle valve 6 remains at the fully opened position. The potentiometer of the accelerator angle sensor 18 is operated by means of the accelerator pedal link 19 within the accelerator angle range in which the throttle valve is fully opened, and the resistance value thereof changes with the change of the accelerator pedal angle.

Figure 3:
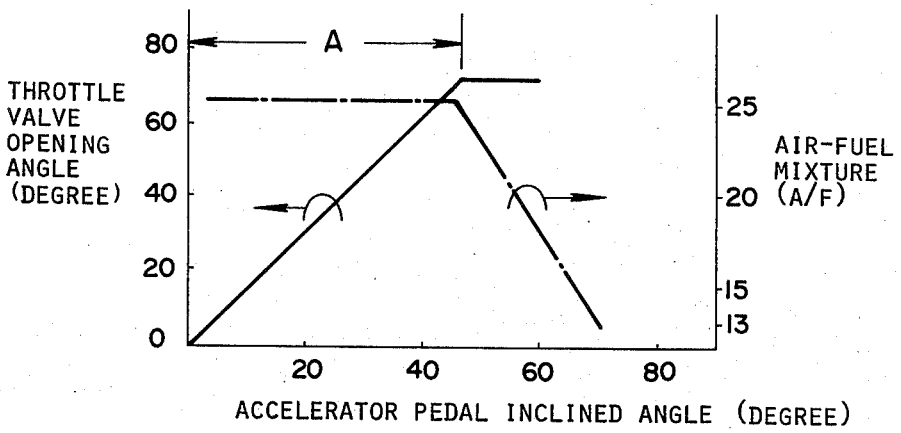
FIG. 3 is a graph of the relationship between the throttle valve opening angle, the angle of inclination of the accelerator pedal, and the air-fuel mixture ratio.

FIG. 3 shows the relationship between accelerator (angle of inclination), throttle valve opening (solid lines), and air-fuel mixture ratio (dash-dotted lines). This Figure illustrates clearly that the throttle valve opens to an extent proportional to the depression of the acceleration up to a certain at which the air/fuel ratio then starts to be decreased in proportion to continued accelerator depression.

Figure 4:
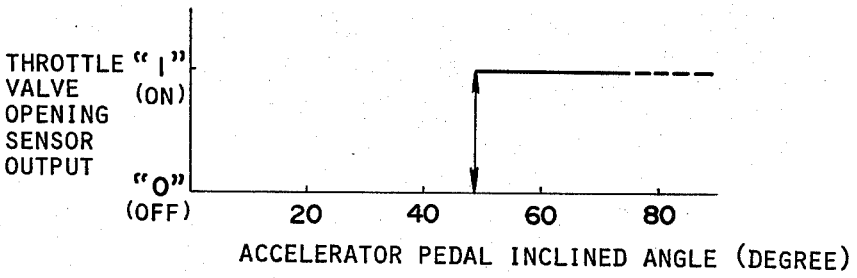
FIG. 4 is a graph of the relationship between the angle of inclination of the accelerator and the ON/OFF output signal from the throttle valve opening sensor.

FIG. 4 shows the relationship between the accelerator angle and the ON/OFF output of the throttle valve opening sensor 7.

Figure 5:
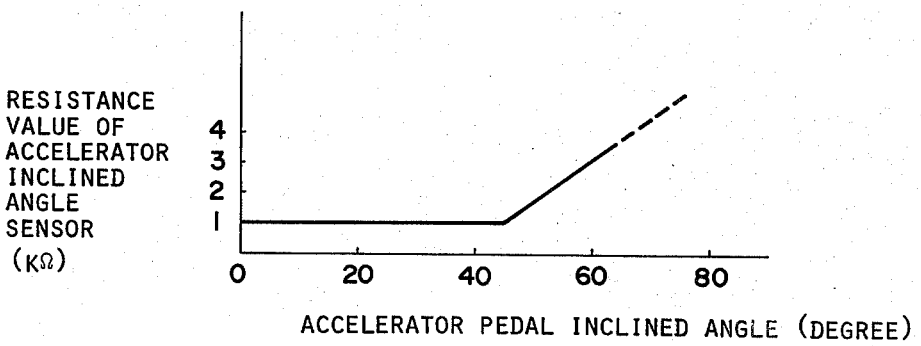
FIG. 5 is a graph of the relationship between the angle of inclination of the accelerator and the resistance of an accelerator angle sensor.

FIG. 5 shows the relationship between the accelerator angle and resistance value of the accelerator angle of inclination sensor 18. These latter graphs show that the same accelerator angle threshold value applies to each of the shown functions. It should be noted that the numerical data shown in FIGS. 3 through 5 are only exemplary data.

Although in the preferred embodiment both the displacement cancelling device 14 and the accelerator angle sensor 18 indicate linear movements, the displacement cancelling device 14 may be attached to the axle of the throttle valve 6 and the accelerator angle sensor 18 may be attached to the accelerator pedal or an axle at the fulcrum of the accelerator pedal link 19. In this case, both or either of the displacement cancelling device 14 and the accelerator angle sensor 18 would indicate rotational movements.

Figure 6:
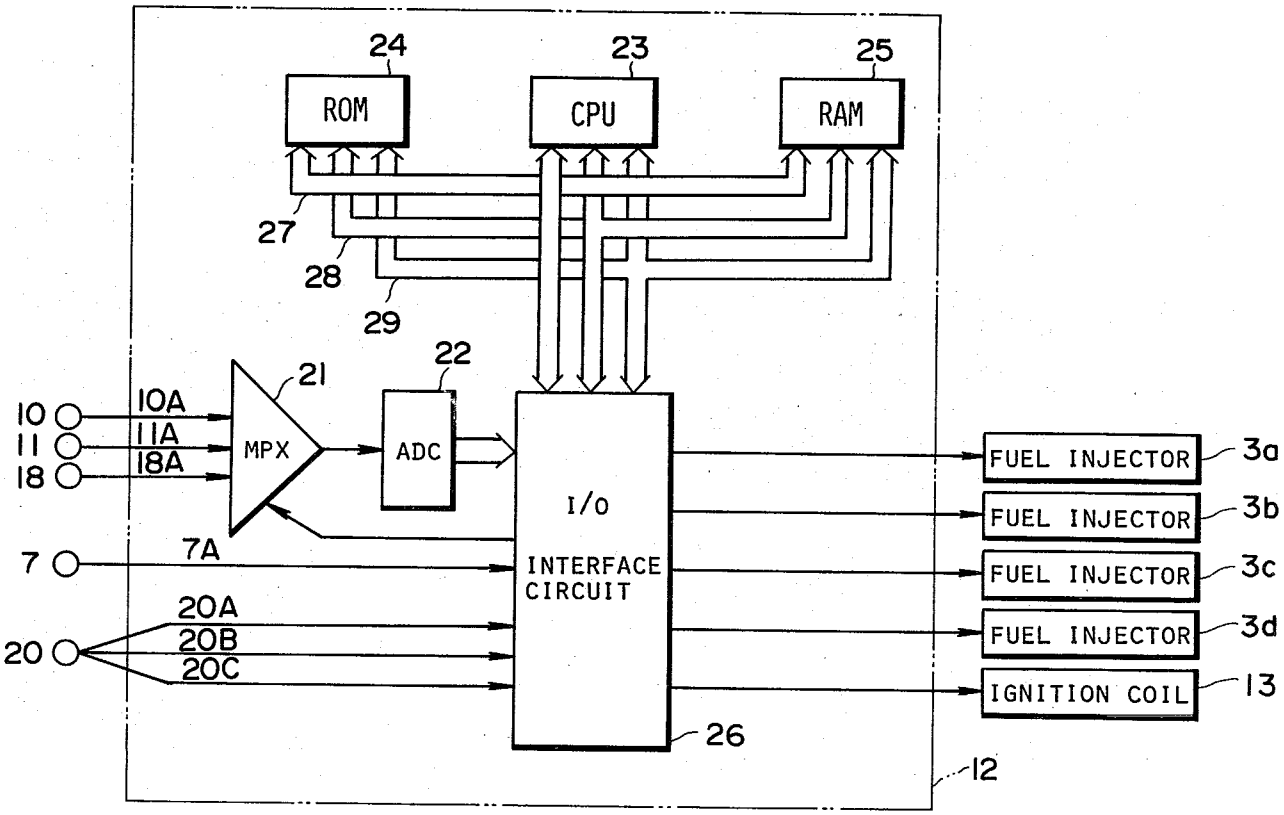
FIG. 6 is a block diagram of the construction of the control unit shown in FIG. 2.

FIG. 6 shows the internal configuration of the control unit 12. The input signals to the control unit 12 may roughly be divided into three kinds of signals. Specifically, one is an analog signal group consisting of output 10A of the intake air quantity sensor 10, output 11A of the cooling water temperature sensor 11, and output 18A of the accelerator pedal angle sensor 18. The analog signals are sent to a multiplexer (MPX)21 and then to an analog-to-digital converter (ADC)22 in a time-sharing mode in response to a select command signal from an I/O interface circuit (I/O)26. The analog-to-digital converter 22 converts each analog signal into a digital signal.

The second group is an ON/OFF signal, i.e., the signal from the throttle valve opening sensor 7. This ON/OFF signal can be processed as a one-bit signal.

Third is a pulse train signal group consisting of a reference crank angle signal 20A (180° signal), a cylinder number discriminating signal 20B (720° signal), and a piston position signal 20C (1° signal). A central processing unit 23 (CPU) performs digital arithmetic operations on the input digital data. The result is outputted to determine the pulsewidth of the drive signal for the fuel injection valves.

In this way, the air-fuel mixture ratio is maintained at a predetermined lean mixture ratio (A/F=18 through 25) until the throttle valve is fully opened as shown in FIG. 3 at which time it starts to smoothly change toward richer mixture ratios (richer means the rate of fuel is greater than that of air in the air-fuel mixture) as the accelerator pedal is depressed further toward the maximum angle of inclination.

Although in the preferred embodiment described above the throttle valve opening sensor 7 outputs the ON signal when the throttle valve is fully opened, it may be preferable for the throttle valve opening sensor 7 to output the ON signal in the vicinity of the throttle valve fully opened position. A read-only memory (ROM) 24 is a memory device which stores a control program and fixed data. A random access memory (RAM) 25 is another read-and-write memory device which stores arithmetically derived data. The input-/output interface circuit 26 sends the signals from the analog-to-digital converter 22, the throttle valve opening sensor 7, and the crank angle sensor 20 into the CPU 23 and sends the signals from the CPU 23 into the fuel injection valves 3*a* through 3*d* and ignition coil 13 as the drive signal of the fuel injection valves and an ignition signal for the ignition coil 13. The CPU 23 determines which of the engine cylinders should next be injected with fuel. In the case of the four-cylinder engine, the fuel injection timing is controlled in an order of first, third, fourth, and second cylinders (#1, #3, #4, and #2). In FIG. 6, numeral 27 denotes a data bus, numeral 28 denotes a control bus, and numeral 29 denotes an address bus.

Figure 7:
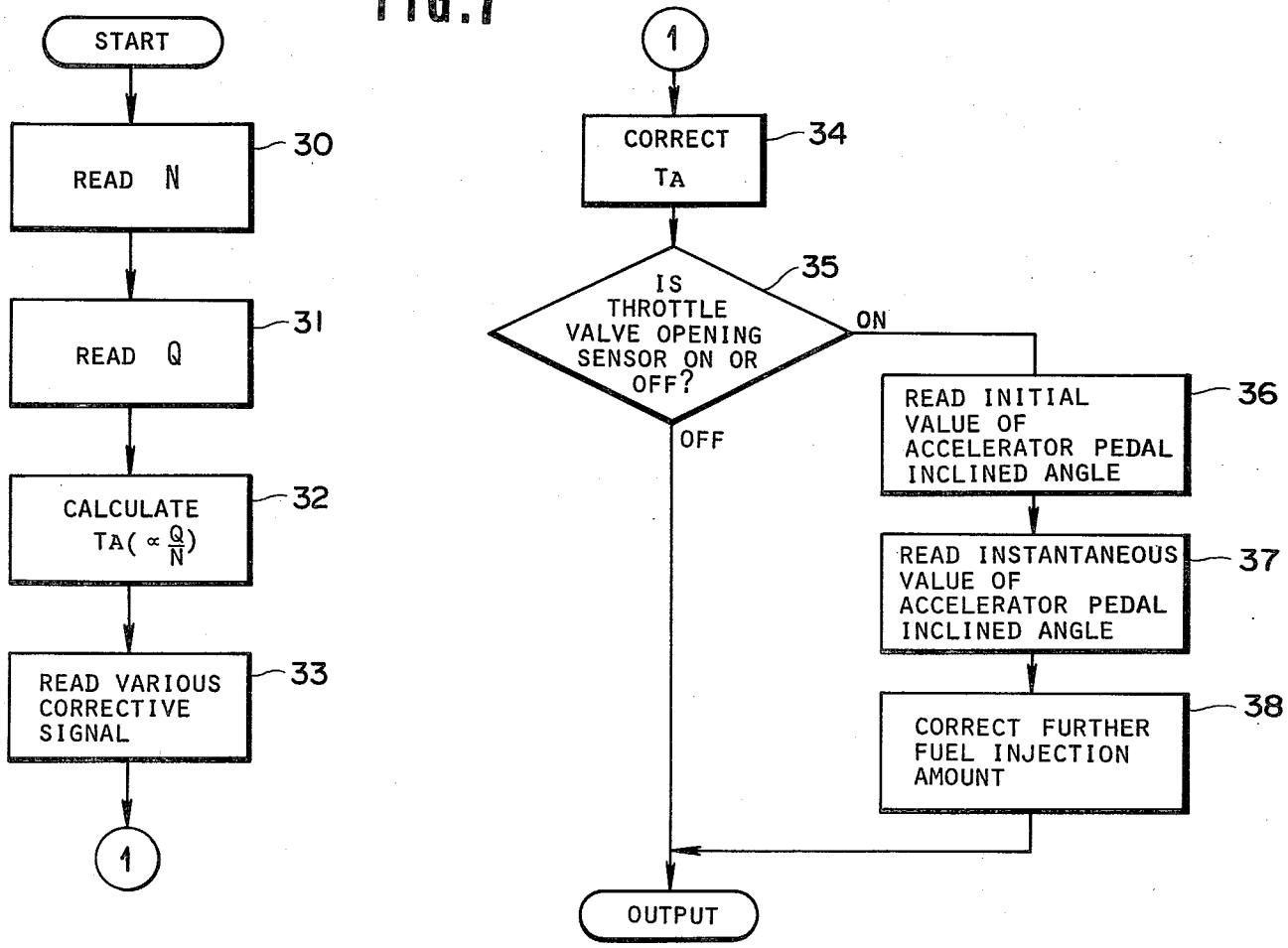
FIG. 7 is a flowchart of the calculation sequence of fuel injection amount in the control unit shown in FIGS. 2 and 6.

An arithmetic operation sequence of determining the fuel injection amount in the CPU 23 is shown in FIG. 7.

As shown in FIG. 7, the CPU 23 reads the current engine revolutions in unit of time from the output 20C of the crank angle sensor 20 in a first step 30. In a subsequent step 31, the CPU 23 reads a current intake air quantity from the signal 10A of the intake air quantity sensor 10. These data are stored in registers within the CPU 23, respectively. From these data, an intake air quantity per engine revolution is calculated to obtain a basic fuel injection amount ($T_A$) in a subsequent step 32. In a subsequent step 33, the CPU reads a corrective signal such as engine cooling water temperature. In a subsequent step 34, the CPU 23 corrects the basic fuel injection amount $T_A$ in accordance with the corrective signal. In a subsequent step 35, the CPU 23 determines whether the throttle valve opening sensor 7 is outputting the ON signal or the OFF signal. If the throttle valve opening sensor 7 is outputting the OFF signal, the value corrected in the step 34 is outputted directly as the fuel injection amount to determine the pulsewidth of the drive signal for the fuel injection valves 3*a* through 3*d*.

As described hereinbefore, the throttle valve 6 is fully opened when the driver depresses the accelerator pedal 5 through a predetermined angle, at which time the throttle valve opening sensor 7 outputs the ON signal. In this case, the CPU 23 reads the digital value of the output of the accelerator pedal angle sensor 7 as an initial value of the accelerator angle and stores the digital value in a register in a step 36. When the driver depresses the accelerator pedal more deeply, the output of the accelerator angle sensor 18 changes according to the angle of inclination and the CPU 23 reads the instantaneous value of the angle of inclination at a step 37. In a subsequent step 38, the CPU 23 calculates the ratio of the initial value of the accelerator pedal angle to the instantaneous value thereof and corrects the fuel injection amount calculated at the step 34 such that the air-fuel mixture becomes richer as the ratio between the initial value of the accelerator pedal angle and instantaneous value calculated in the step 38 becomes larger.

As described hereinabove, since the engine is operated on a lean air-fuel mixture during partial-load operation and the engine is operated on a richer air-fuel mixture during full-load operation, such a case as when the vehicle is abruptly accelerated or the vehicle ascends a long slope, the air-fuel mixture being smoothly changed from the lean air-fuel mixture ratio to the richer air-fuel mixture ratio according to the angle of inclination of the accelerator pedal as the engine changes from the partial-load state to the full-load state, abrupt change in the vehicle traveling speed due to the rapid change in the air-fuel mixture when the fuel injection amount is incremented during full engine load can be prevented. Furthermore, reduction of fuel consumption can be achieved without degrading handling characteristics.

It will fully be understood by those skilled in the art that the foregoing description is in terms of the preferred embodiment of the present invention wherein various changes and modifications may be made without departing the spirit and scope of the present invention, which is to be defined by the appended claims.

What is claimed is:

1. An electronically controlled fuel injection system for an internal combustion engine in which a plurality of sensors produces signal indicative of engine operating conditions and a control unit determines the amount of fuel to be injected into the engine in accordance with the sensor signals and in which the degree of opening and closing of a throttle valve regulating intake air flow into the engine is actuated in direct proportion to the angle of inclination of a manually operable accelerator pedal, comprising:

(a) an accelerator angle sensor which produces a signal indicative of the angle of inclination of the accelerator pedal;

(b) a throttle valve sensor which produces a fully-open signal when the throttle valve is open to a degree approximating its fully open state;

(c) means for disengaging the accelerator pedal from the throttle valve when the angle of inclination of the accelerator pedal exceeds a certain angle at which the throttle valve sensor produces the fully-open signal so that the throttle valve remains at or near its fully open position while the angle of inclination of the accelerator pedal exceeds said certain angle; and (d) said control unit being responsive to the throttle valve sensor and the accelerator angle sensor to control the fuel quantity injected into the engine so as to adjust the air/fuel ratio of the resultant air/fuel mixture in inverse proportion to the angle of inclination of the accelerator pedal in the presence of the fully-open signal from the throttle valve sensor.

2. An electronically controlled fuel injection system for an internal combustion engine of an automotive vehicle which determines the pulsewidth of a drive signal to be applied to a plurality of fuel injection valves to actuate each valve to inject a calculated amount of fuel into the engine, which comprises:

(a) means for absorbing the displacement of an accelerator pedal after a throttle valve is fully opened, the throttle valve being fully opened before the angle of inclination through which a vehicle driver depresses the accelerator pedal reaches its maximal limit;

(b) a throttle valve opening sensor means which detects whether the throttle valve is fully opened or the throttle valve is open by more than a predetermined angle, the predetermined angle being in the vicinity of the fully opened angle;

(c) an accelerator pedal angle sensor which detects an angle of inclination through which the vehicle driver depresses the accelerator pedal and produces a signal corresponding thereto;

(d) an intake air quantity sensor means which detects and produces a signal corresponding to the intake air quantity of the engine; and (e) means responsive to signals from said throttle valve opening sensor and accelerator pedal angle sensors for determining the amount of fuel to be injected into each engine cylinder in relation to the output of said intake air quantity sensor means such that the air-fuel mixture ratio is maintained at a predetermined lean air-fuel mixture ratio until the throttle valve is fully opened or open by more than the predetermined angle and correcting the determined amount of fuel in relation to the output of said accelerator pedal angle sensor such that the air-fuel mixture ratio becomes richer as the accelerator angle approaches the maximum angle when said opening sensor detects that the throttle valve is fully opened or open by more than the predetermined angle.

3. The electronically controlled fuel injection system as set forth in claim 2, wherein said displacement absorbing means is located at an intermediate point along an accelerator cable interlinking the accelerator pedal and throttle valve and said displacement absorbing means comprises a cylinder having one end connected to the accelerator pedal via the accelerator cable, an elastic member located within said cylinder and having one end connected to other end of said cylinder, and rod connected between the other end of said elastic member and throttle valve via the accelerator cable.

* * * * *